US007205561B2

(12) United States Patent
Chelvayohan et al.

(10) Patent No.: US 7,205,561 B2
(45) Date of Patent: Apr. 17, 2007

(54) MEDIA SENSOR APPARATUS USING A TWO COMPONENT MEDIA SENSOR FOR MEDIA ABSENCE DETECTION

(75) Inventors: Mahesan Chelvayohan, Lexington, KY (US); Charles Jarratt Simpson, Lexington, KY (US); Herman Anthony Smith, Winchester, KY (US)

(73) Assignee: Lexmark International, Inc., Lexington, KY (US)

( * ) Notice: Subject to any disclaimer, the term of this patent is extended or adjusted under 35 U.S.C. 154(b) by 319 days.

(21) Appl. No.: 10/812,340

(22) Filed: Mar. 29, 2004

(65) Prior Publication Data

US 2005/0211931 A1 Sep. 29, 2005

(51) Int. Cl.
*G01N 21/86* (2006.01)
*G01N 21/84* (2006.01)
*B41J 29/393* (2006.01)

(52) U.S. Cl. ..... 250/559.4; 250/559.16; 356/431; 347/19

(58) Field of Classification Search ..... 250/559.4, 250/559.16, 559.17, 559.18; 347/19, 105, 347/448; 356/431, 444, 445, 446, 447, 448
See application file for complete search history.

(56) References Cited

U.S. PATENT DOCUMENTS

| | | | | |
|---|---|---|---|---|
| 4,066,969 | A | 1/1978 | Pearce et al. | 328/5 |
| 4,092,068 | A | 5/1978 | Lucas et al. | 356/73 |
| 4,352,988 | A | 10/1982 | Ishida | 250/559 |
| 4,525,630 | A | 6/1985 | Chapman | 250/572 |
| 4,540,887 | A | 9/1985 | Minerd et al. | 250/561 |
| 4,545,031 | A | 10/1985 | Kobayashi | 364/900 |
| 4,578,770 | A | 3/1986 | Mitani | 364/571 |
| 4,613,235 | A | 9/1986 | Suga | 356/446 |
| 4,642,456 | A | 2/1987 | Watanabe | 250/223 |
| 4,642,457 | A | 2/1987 | Watanabe | 250/223 |
| 4,673,818 | A | 6/1987 | Guerra | 250/571 |
| 4,685,982 | A | 8/1987 | Kucheck | 156/64 |
| 4,721,968 | A | 1/1988 | Arai et al. | 346/136 |
| 4,774,551 | A | 9/1988 | Amos et al. | 355/68 |
| 4,929,844 | A | 5/1990 | Houjiyou et al. | 250/561 |
| 4,945,253 | A | 7/1990 | Frohardt | 250/571 |
| 4,950,905 | A * | 8/1990 | Butler et al. | 250/358.1 |
| 4,954,846 | A | 9/1990 | Matsuo et al. | 355/311 |
| 4,958,069 | A | 9/1990 | Okamori | 250/223 |
| 4,963,731 | A | 10/1990 | King | 250/560 |
| 4,970,544 | A | 11/1990 | Furusawa et al. | 355/24 |
| 4,970,606 | A | 11/1990 | Shima | 358/474 |
| 4,982,235 | A | 1/1991 | Fujino | 355/235 |

(Continued)

*Primary Examiner*—Georgia Epps
*Assistant Examiner*—Don Williams
(74) *Attorney, Agent, or Firm*—Taylor & Aust

(57) ABSTRACT

An imaging apparatus includes a media support surface. A light source and a light detector are positioned in relation to a reflective surface such that when a sheet of print media covers the reflective surface, a reflected specular light component of a light beam is received by the light detector, and when the reflective surface is not covered, the reflective surface directs the reflected specular light component of the light beam away from the detector. The signal strength of the output from the light detector when receiving a diffuse light component reflected from the reflective surface is less than the signal strength of the output from the light detector when receiving the reflected specular light component that is reflected from a low reflectance print media.

18 Claims, 6 Drawing Sheets

U.S. PATENT DOCUMENTS 4,985,636 A 1/1991 Fukui et al. ..... 250/559
4,989,985 A 2/1991 Hubble, III et al. ..... 356/445
4,994,678 A 2/1991 Sasaki ..... 250/560
5,084,627 A 1/1992 Ueki et al. ..... 250/561
5,122,833 A 6/1992 Sato ..... 355/203
5,139,339 A * 8/1992 Courtney et al. ..... 356/446
5,172,003 A 12/1992 Nasu et al. ..... 250/561
5,225,688 A 7/1993 Endo ..... 250/560
5,250,813 A 10/1993 Takahashi et al. ..... 250/561
5,262,637 A 11/1993 Cumberledge et al. ..... 250/223
5,329,338 A 7/1994 Merz et al. ..... 355/207
5,354,995 A 10/1994 Endo et al. ..... 250/561
5,508,520 A 4/1996 Shoji et al. ..... 250/559
5,508,521 A 4/1996 Kraft et al. ..... 250/574
5,661,571 A 8/1997 Ijuin et al. ..... 358/471
5,689,757 A 11/1997 Ferrante et al. ..... 399/45
5,751,443 A 5/1998 Borton et al. ..... 356/446
5,751,854 A 5/1998 Saitoh et al. ..... 382/218
5,764,251 A 6/1998 Hashimoto ..... 347/16
5,811,777 A 9/1998 Ackley ..... 235/462
5,856,833 A 1/1999 Elgee et al. ..... 347/19
5,925,889 A 7/1999 Guillory et al. ..... 250/559.16
6,006,668 A 12/1999 Rehmann ..... 101/484
6,018,164 A 1/2000 Mullens ..... 250/559.4
6,019,449 A 2/2000 Bullock et al. ..... 347/14
6,031,620 A 2/2000 Typpo ..... 356/445
6,079,807 A 6/2000 Lindstrom et al. ..... 347/16
6,088,104 A 7/2000 Peterson ..... 356/371
6,088,546 A 7/2000 Inoue et al. ..... 399/45
6,144,811 A 11/2000 Ohori et al. ..... 399/9
6,152,443 A 11/2000 Claramunt et al. .... 271/258.05
6,201,255 B1 3/2001 Torchalski et al. ..... 250/559.4
6,215,552 B1 4/2001 Acquaviva et al. ..... 356/371
6,217,168 B1 4/2001 Elgee ..... 347/105
6,233,053 B1 5/2001 Preston et al. ..... 356/445
6,242,733 B1 6/2001 Ma et al. ..... 250/233
6,291,829 B1 9/2001 Allen et al. ..... 250/559.07
6,325,505 B1 12/2001 Walker ..... 347/105
6,348,697 B1 2/2002 Kitajima ..... 250/559.4
6,365,889 B1 4/2002 Elgee ..... 250/221
6,386,676 B1 5/2002 Yang et al. ..... 347/19
6,398,206 B1 6/2002 Yang et al. ..... 271/90
6,400,099 B1 6/2002 Walker ..... 315/291
6,520,614 B2 2/2003 Kaneko ..... 347/14
6,549,286 B2 4/2003 Komulainen et al. ..... 356/600
6,561,643 B1 5/2003 Walker et al. ..... 347/105
6,585,341 B1 7/2003 Walker et al. ..... 347/14
6,600,167 B2 7/2003 Sano ..... 250/559.11
6,677,603 B2 1/2004 Yanagiuchi ..... 250/559.4
2003/0020029 A1 1/2003 Henry et al. ..... 250/559.4
2003/0052934 A1 3/2003 Maruyama ..... 347/16

* cited by examiner

MEDIA SENSOR APPARATUS USING A TWO COMPONENT MEDIA SENSOR FOR MEDIA ABSENCE DETECTION

BACKGROUND OF THE INVENTION

1. Field of the Invention

The present invention relates to media sensing, and, more particularly, to a media sensor apparatus using a two component media sensor for media absence detection.

2. Description of the Related Art

A three component media sensor includes a light source and a pair of light detectors, one of the light detectors being positioned to sense reflected diffuse light and a second detector positioned to sense reflected specular light. Such a sensor may be used, for example, to detect the presence of print media and discriminate between media types, such as for example, paper media and transparency media. Such determinations are made by optically measuring the glossiness of the media, or media support surface.

For example, to measure the glossiness, a collimated beam of light is directed towards the media and a reflectance ratio (R) of the detected reflected specular light intensity and the detected diffusively scattered light intensity is calculated. The media sensor is initially calibrated by measuring a reflectance ratio (R0) on a known gloss media. A normalized reflectance ratio (Rn) is calculated using the formula: Rn=(R/R0). Normalized reflectance ratio Rn then is used to identify the media type of an unknown media by a comparison of the normalized reflectance ratio Rn to a plurality of normalized reflectance ratio Rn ranges, each range being associated with a particular type of media, or the absence of media.

Typically, however, a three component media sensor is more expensive than a two component media sensor.

What is needed in the art is a media sensing apparatus that can detect the absence of print media reliably using a two component media sensor.

SUMMARY OF THE INVENTION

The present invention provides a media sensing apparatus that can detect the absence of print media reliably using a two component media sensor.

The present invention, in one form thereof, relates to an apparatus including a media support surface. A first normal line extends perpendicular to a plane of the media support surface. A light source is positioned at a first angle with respect to the first normal line, the light source producing a light beam. A light detector is positioned at a second angle with respect to the first normal line. The light source and the light detector are positioned on opposite sides of the first normal line. The light detector provides an output. A reflective surface is formed near the media support surface. A second normal line extends perpendicular to the reflective surface. The first normal line and the second normal line are non-parallel. The reflective surface is formed at a third angle with respect to the plane of the media support surface. The light source and the light detector are positioned in relation to the reflective surface such that when a sheet of print media covers the reflective surface, a reflected specular light component of the light beam is received by the light detector, and when the reflective surface is not covered, the reflective surface directs the reflected specular light component of the light beam away from the light detector. The output of the light detector provides an indication of a presence or an absence of the sheet of print media. The signal strength of the output from the light detector when receiving a diffuse light component reflected from the reflective surface is less than the signal strength of the output from the light detector when receiving the reflected specular light component that is reflected from a low reflectance print media.

In another form thereof, the present invention relates to a method of detecting the presence or absence of a sheet of print media. The method includes the steps of providing a media support surface, and a first normal line extending perpendicular to a plane of the media support surface; providing a light source positioned at a first angle with respect to the first normal line, the light source producing a light beam; providing a light detector positioned at a second angle with respect to the first normal line, the light source and the light detector being positioned on opposite sides of the first normal line, the light detector providing an output; providing a reflective surface formed near the media support surface, and a second normal line extending perpendicular to the reflective surface, the first normal line and the second normal line being non-parallel, the reflective surface being formed at a third angle with respect to the plane of the media support surface; positioning the light source and the light detector in relation to the reflective surface such that when the sheet of print media covers the reflective surface, a reflected specular light component of the light beam is received by the light detector, and when the reflective surface is not covered, the reflective surface directs the reflected specular light component of the light beam away from the light detector, the output of the light detector providing an indication of a presence or an absence of the sheet of print media; and determining a signal strength of the output from the light detector, wherein the signal strength of the output from the light detector when receiving a diffuse light component reflected from the reflective surface is less than the signal strength of the output from the light detector when receiving the reflected specular light component that is reflected from a low reflectance print media.

In still another form thereof, the present invention relates to a media sensing apparatus. A reflective surface has a normal line extending perpendicular to the reflective surface. A media sensor has a centerline. The media sensor includes a light source and a light detector. The light source and the light detector are positioned on opposite sides of the centerline. The light source produces a light beam. The light detector provides an output. The light source and the light detector are positioned with respect to the reflective surface. A controller is communicatively coupled to the light detector to receive the output of the light detector. The controller determines a signal strength of the output from the light detector, wherein the signal strength of the output from the light detector when receiving a diffuse light component reflected from the reflective surface is less than the signal strength of the output from the light detector when receiving a reflected specular light component that is reflected from a low reflectance print media. The controller determines a presence or an absence of a sheet of print media based on the signal strength of the output from the light detector.

An advantage of the present invention is that the presence or absence of print media can be determined with a simple two component media sensor, having a single light detector.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
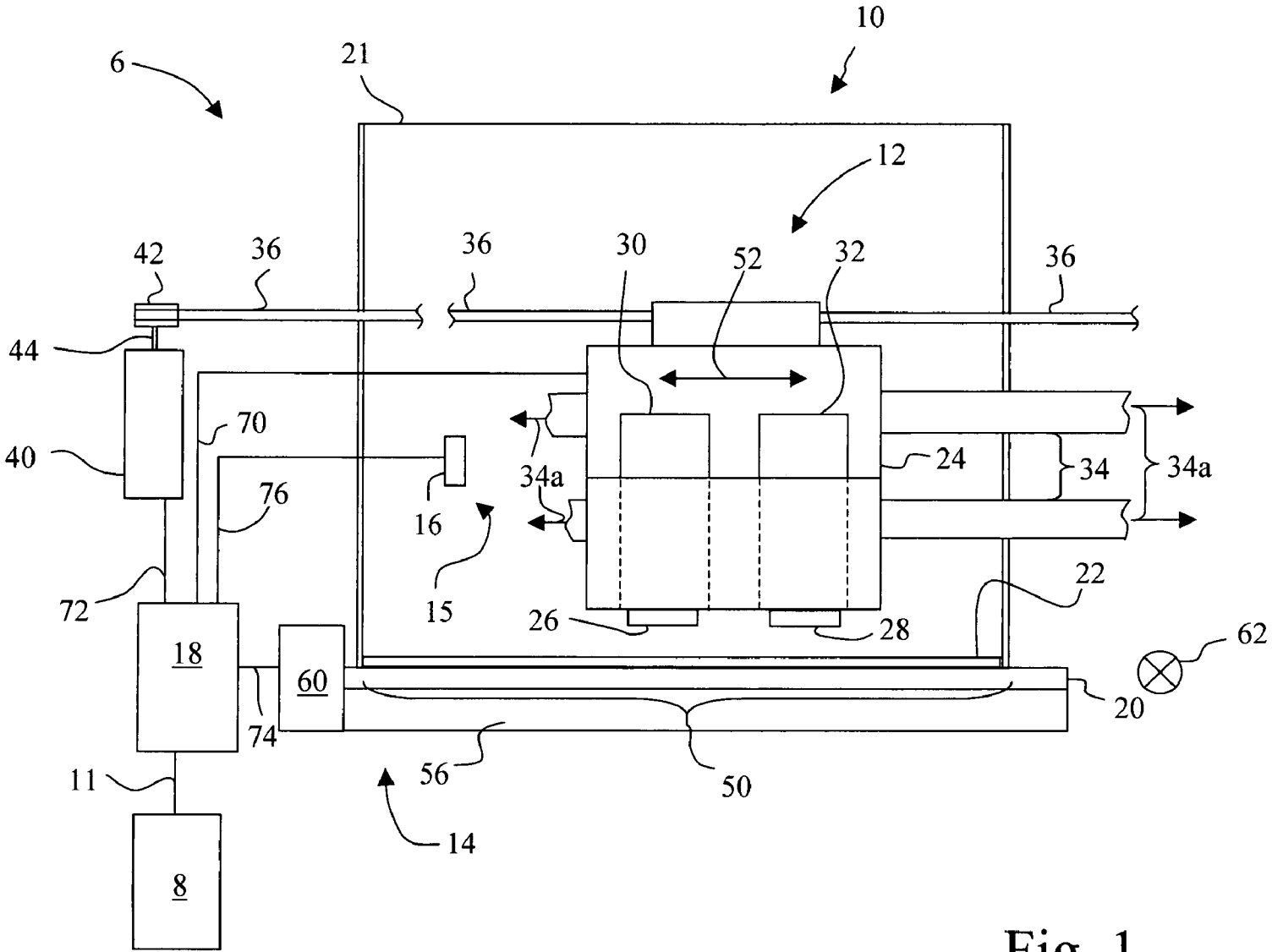
FIG. 1 is a diagrammatic representation of an imaging system embodying the present invention.
Figure 2:
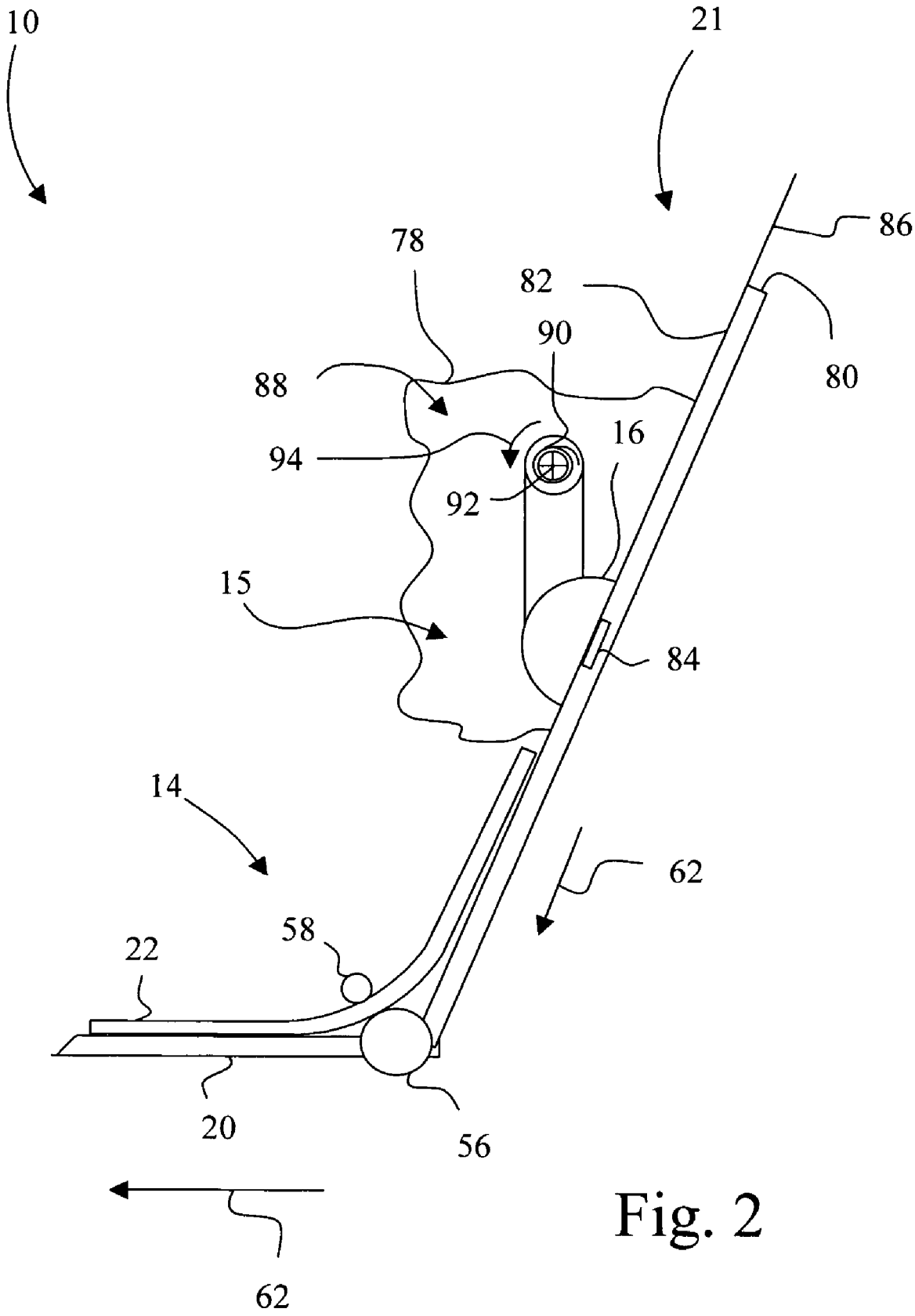
FIG. 2 is a side diagrammatic representation of a portion of the imaging apparatus of the imaging system of FIG. 1.

Referring now to the drawings, and particularly to FIGS. 1 and 2, there is shown an imaging system 6 embodying the present invention. Imaging system 6 may include a host 8 and an imaging apparatus 10, or alternatively, imaging system 6 may be a standalone system not attached to a host.

Host 8, which may be optional, may be communicatively coupled to imaging apparatus 10 via a communications link 11. Communications link 11 may be established, for example, by a direct cable connection, wireless connection or by a network connection such as for example an Ethernet local area network (LAN).

In embodiments including host 8, host 8 may be, for example, a personal computer including an input/output (I/O) device, such as keyboard and display monitor. Host 8 further includes a processor, input/output (I/O) interfaces, memory, such as RAM, ROM, NVRAM, and may include a mass data storage device, such as a hard drive, CD-ROM and/or DVD units. During operation, host 8 includes in its memory a software program including program instructions that function as an imaging driver, e.g., printer driver software, for imaging apparatus 10. The imaging driver facilitates communication between host 8 and imaging apparatus 10, and may provide formatted print data to imaging apparatus 10. Alternatively, however, all or a portion of the imaging driver may be incorporated into imaging apparatus 10.

Imaging apparatus 10, in the form of an ink jet printer, includes a printhead carrier system 12, a feed roller unit 14, a media sensing apparatus 15 including a media sensor 16, a controller 18, a mid-frame 20 and a media source 21.

Media source 21 is configured and arranged to supply individual sheets of print media 22 to feed roller unit 14, which in turn further transports the sheets of print media 22 during a printing operation.

Printhead carrier system 12 includes a printhead carrier 24 for carrying a color printhead 26 and a black printhead 28. A color ink reservoir 30 is provided in fluid communication with color printhead 26, and a black ink reservoir 32 is provided in fluid communication with black printhead 28. Printhead carrier system 12 and printheads 26, 28 may be configured for unidirectional printing or bi-directional printing.

Printhead carrier 24 is guided by a pair of guide rods 34. The axes 34*a* of guide rods 34 define a bi-directional scanning path for printhead carrier 24, and thus, for convenience the bi-directional scanning path will be referred to as bi-directional scanning path 34*a*. Printhead carrier 24 is connected to a carrier transport belt 36 that is driven by a carrier motor 40 via a carrier pulley 42. Carrier motor 40 has a rotating carrier motor shaft 44 that is attached to carrier pulley 42. At the directive of controller 18, printhead carrier 24 is transported in a reciprocating manner along guide rods 34. Carrier motor 40 can be, for example, a direct current (DC) motor or a stepper motor.

The reciprocation of printhead carrier 24 transports ink jet printheads 26, 28 across the sheet of print media 22, such as paper, along bi-directional scanning path 34*a* to define a print zone 50 of imaging apparatus 10. This reciprocation occurs in a main scan direction 52 that is parallel with bi-directional scanning path 34*a*, and is also commonly referred to as the horizontal direction. During each scan of printhead carrier 24, the sheet of print media 22 is held stationary by feed roller unit 14.

Referring to FIG. 2, feed roller unit 14 includes an feed roller 56 and corresponding pinch rollers 58. Feed roller 56 is driven by a drive unit 60 (FIG. 1). Pinch rollers 58 apply a biasing force to hold the sheet of print media 22 in contact with respective driven feed roller 56. Drive unit 60 includes a drive source, such as a stepper motor, and an associated drive mechanism, such as a gear train or belt/pulley arrangement. Feed roller unit 14 feeds the sheet of print media 22 in a sheet feed direction 62 (see FIGS. 1 and 2).

Controller 18 is electrically connected to printheads 26 and 28 via a printhead interface cable 70. Controller 18 is electrically connected to carrier motor 40 via an interface cable 72. Controller 18 is electrically connected to drive unit 60 via an interface cable 74. Controller 18 is electrically connected to media sensor 16 via an interface cable 76.

Controller 18 includes a microprocessor having an associated random access memory (RAM) and read only memory (ROM). Controller 18 executes program instructions to effect the printing of an image on the sheet of print media 22, such as coated paper, plain paper, photo paper and transparency. In addition, controller 18 executes instructions to conduct media sensing, and more particularly, for detecting whether print media 22 is present or absent based on information received from media sensor 16.

Referring to FIG. 2, media source 21 is attached, at least in part, to a frame 78 of imaging apparatus 10. Media source 21 includes a media support 80 including a planar media support surface 82. A reflector portion 84 of media support 80 is positioned near, e.g., adjacent to, media support surface 82. Reflector portion 84 may be, for example, molded with media support 80. Reflector portion 84 is a part of media sensing apparatus 15. Reflector portion 84 is located to be proximate to and opposite to media sensor 16.

Figure 4:
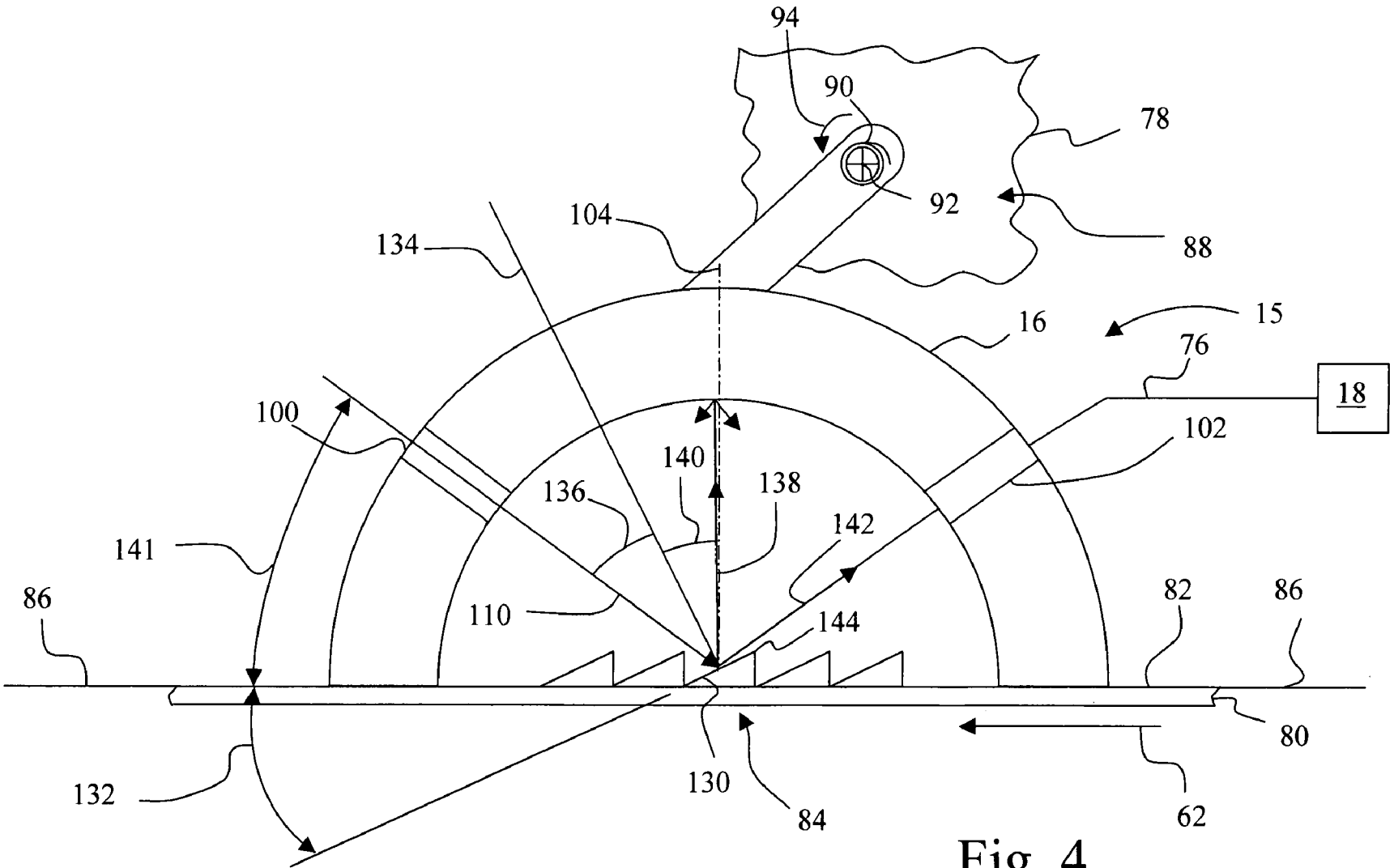
FIG. 4 is a first embodiment of a media sensing apparatus embodying the present invention.
Figure 5:
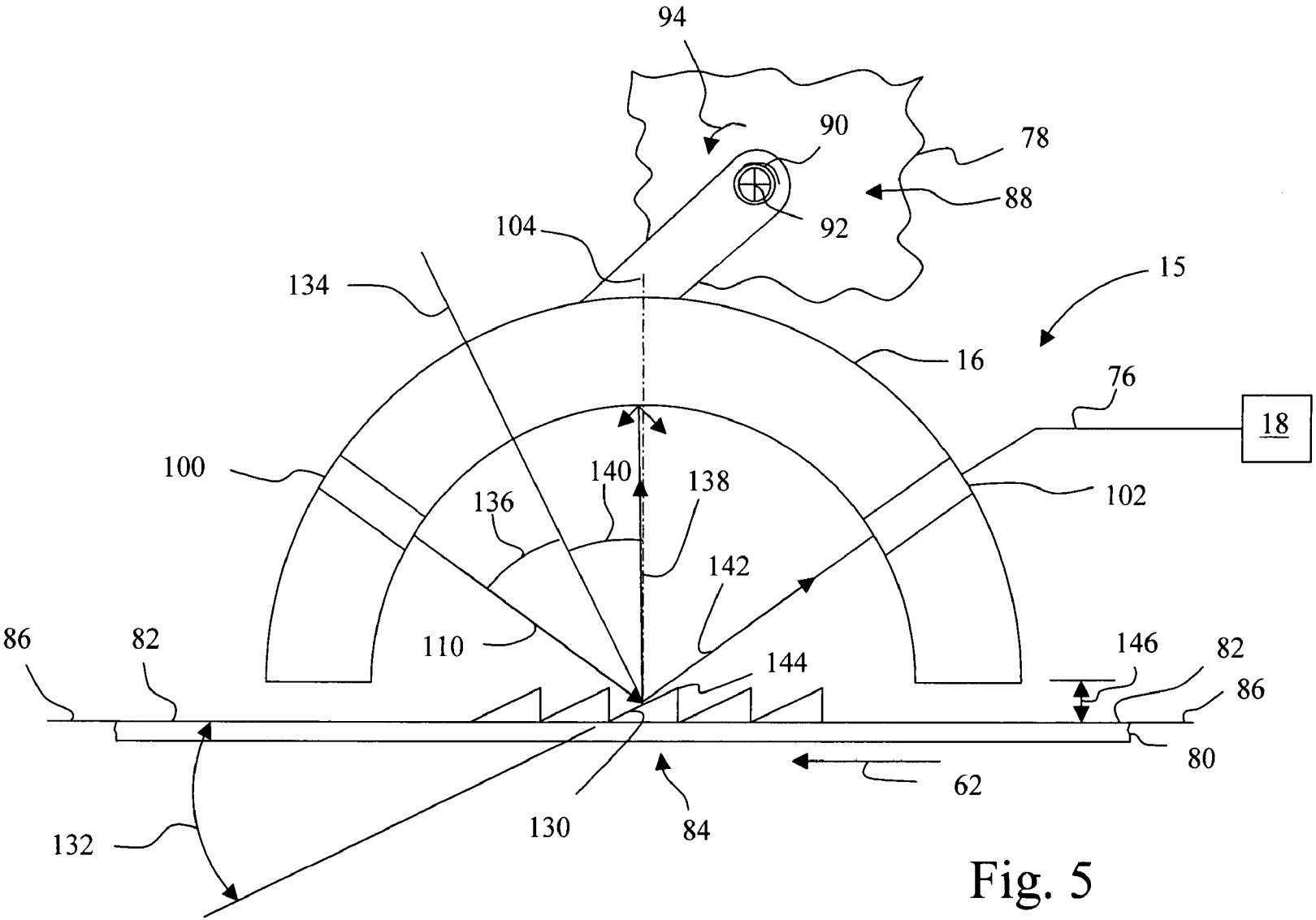
FIG. 5 is another embodiment of a media sensing apparatus embodying the present invention.

In the embodiments of the present invention of FIGS. 4 and 5, for example, reflector portion 84 defines at least one angled surface that is non-parallel to a plane 86 of media support surface 82, so as to change the direction of reflection of the specular light from that which would have been associated with media support surface 82 in the absence of reflector portion 84.

Referring again to FIG. 2, media sensor 16 is mounted to frame 78 via a pivot arm arrangement 88 that is biased by a spring 90 to pivot about axis 92 in the direction indicated by arrow 94. Alternatively, pivot arm arrangement 88 may be biased simply by the forces of gravity. If no stops are provided on pivot arm arrangement 88, when no sheet of media is present between reflector portion 84 of media support 80 and media sensor 16, media sensor 16 will contact media support surface 82 of media support 80 (see FIG. 4). Alternatively, however, a guide roller (not shown) may be installed to limit the pivoting of pivot arm arrangement 88 such that media sensor 16 is maintained at a predefined distance from the sensing surface, for example, from the sheet of print media 22 or from reflector portion 84 of media support 80 (see FIG. 5). Such a predefined distance may be, for example, one millimeter.

The present invention utilizes the fact that, with the configuration of the two component media sensor 16, the signal strength of the output from light detector 102 when receiving the diffuse light component reflected from a glossy surface of reflector portion 84 is significantly less than the signal strength of the output from light detector 102 when receiving the reflected specular light component of a low reflectance print media, such as for example, a coated paper or other media with a matte finish. Accordingly, with the present invention a print media present/absent determination can be made based only on the signal strength of the output of light detector 102 of the two component media sensor 16, without having to resort to complicated measurements and calculations for determining a reflectance ratio of the detected reflected specular light intensity and the detected diffusively scattered light intensity, such as in the case of using a three component media sensor (having a light source and two detectors).

Figure 3:
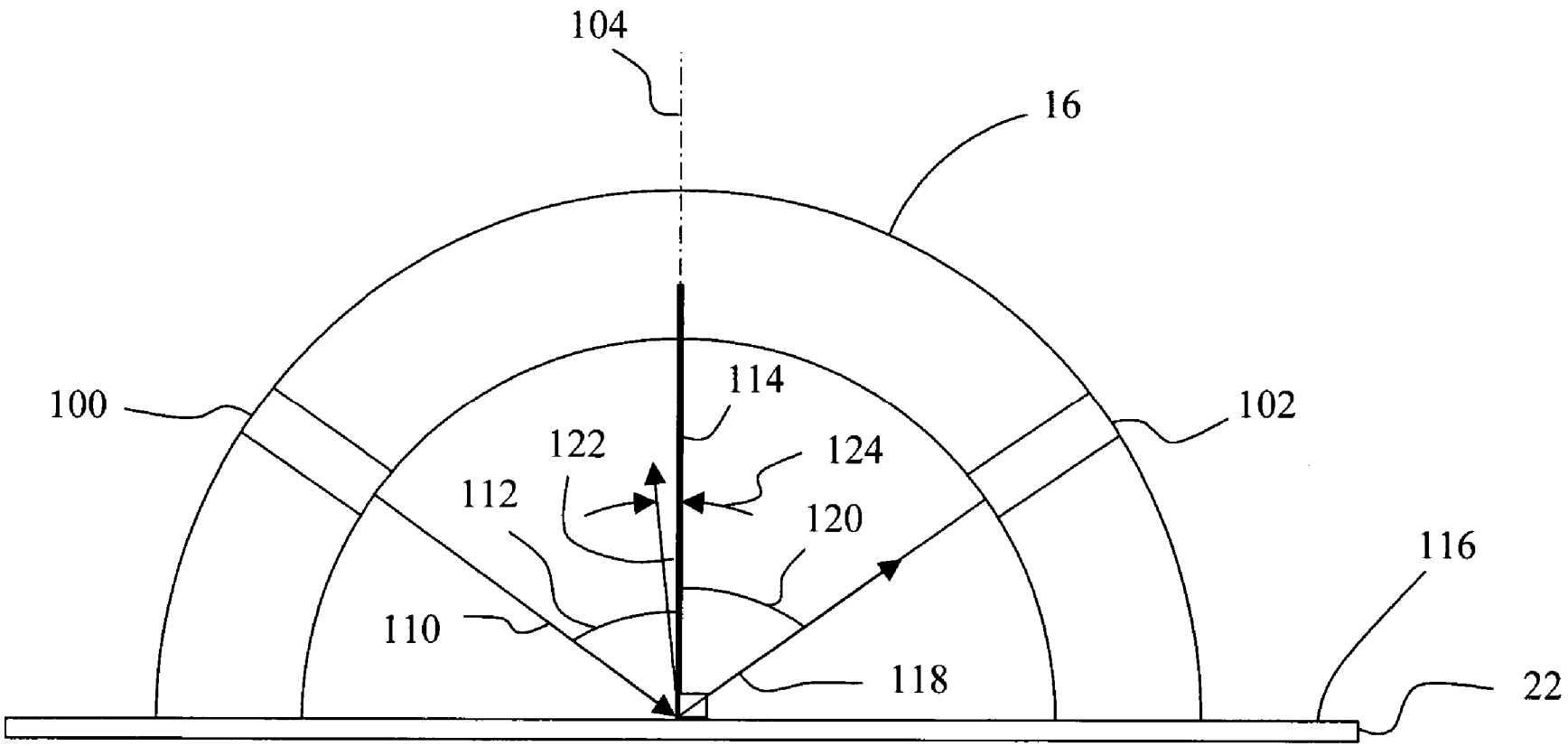
FIG. 3 is a side diagrammatic representation of a media sensor in accordance with the present invention.

Referring to FIG. 3, media sensor 16 may be, for example, a unitary optical sensor including a light source 100 and a light detector 102. Light source 100 and a light detector 102 are arranged in a fix relationship relative to one another, and located on opposite sides of a centerline 104 of media sensor 16. In its simplest form, light source 100 may include, for example, a light emitting diode (LED). In a more complex form, light source 100 may further include additional optical components for generating a collimated light beam, such as light beam 110. Light detector 102 may be, for example, a phototransistor, and may be the sole light detector in media sensor 16.

As shown in FIG. 3, light source 100 and light detector 102 are located to be on the same side of the sheet of print media 22, and facing the sheet of print media 22. Light source 100 is positioned at a predefined angle 112 with respect to centerline 104, and light detector 102 is positioned at a predefined angle 120 with respect to centerline 104. As shown, light source 100 and light detector 102 are positioned on opposite sides of centerline 104. Further, in the embodiment shown, angle 112 is substantially equal to angle 120.

In FIG. 3, light source 100 of media sensor 16 directs light beam 110 toward 5 print media 22 at angle 112 with respect to centerline 104 of media sensor 16. In the arrangement shown, centerline 104 of media sensor 16 corresponds to a normal line 114 that is normal, i.e., perpendicular, to a material surface 116 of the sheet of print media 22. The light beam impinges material surface 116, and a specular light component 118 is reflected from material surface 116 at angle 120 from normal line 114, and is received by light detector 102. Diffuse light components of the reflected light, such as exemplary diffuse light component 122 reflected at an angle 124, for example approximately 2 degrees from normal line 114, are generally reflected away from light detector 102. The strength of an output signal generated by light detector 102 is dependent upon the amount of reflected light received by light detector 102.

Referring to the exemplary embodiments of the present invention of FIGS. 4 and 5, a reflector portion 84 of media support 80 is located adjacent to media support surface 82 and opposite to media sensor 16. Reflector portion 84 is configured to cause the specular light components (predominant with respect to diffuse light components) to be directed away from light detector 102 in the absence of print media 22 being interposed between media sensor 16 and reflector portion 84, although at least some of the diffuse light components may be received by light detector 102. In contrast, when a sheet of print media 22 is present between media sensor 16 and reflector portion 84, specular light components reflected from the sheet of print media 22 are directed to light detector 102.

With the configuration of the present invention, the signal strength of the output of light detector 102 when receiving the diffuse light components in the absence of print media sheet 22 is significantly less than the output of light detector 102 when receiving the specular light components of the least reflective print media, i.e., the most diffuse media type, such as for example, a sheet of coated paper. For example, the output of light detector 102 in the absence of print media sheet 22 may be about 10 microamps, whereas the output of light detector 102 when the sheet of print media 22 is present is about 100 microamps. Controller 18 may include an analog port to receive the analog output of light detector 102, which then determines the presence or absence of print media sheet 22 by comparing a digital equivalent of the analog output to a threshold.

Those skilled in the art will recognize that the output of light detector 102 may be processed in a variety of ways in order for controller 18 to make the media present/absent determination. For example, light detector 102 may be configured with an analog-to-digital converter to provide digital signals directly to controller 18. As a further alternative, for example, the output of light detector 102 may be supplied to a comparator having a switching threshold, such that the output of the comparator switches from low to high when the output of light detector 102 indicates the presence of print media 22.

In the embodiment of FIG. 4, media sensor 16 is positioned proximate to and facing reflector portion 84 of media support 80. In the embodiment of FIG. 4, centerline 104 of media sensor 16 also represents a normal line that is normal to the plane of media support 80, i.e., perpendicular to media support surface 82. Pivot arm arrangement 88 is biased by spring 90 to pivot about axis 92 in the direction indicated by arrow 94 such that, when no sheet of media is present between reflector portion 84 of media support 80 and media sensor 16, media sensor 16 will contact media support surface 82 of media support 80.

Reflector portion 84 includes an angled reflective surface 130 that extends in a direction non-parallel to plane 86 of media support 80 at an angle 132. Angled reflective surface 130 may have, for example, a high gloss finish, similar to the surface characteristics of a transparency. The size and extent of angled reflective surface 130 is greatly exaggerated in FIG. 4 so that the details of the angular relationship of the various components can be seen more clearly.

As is apparent in FIG. 4, plane 86 extends across reflector portion 84. Angle 132 is selected such that angled reflective surface 130 defines a normal line 134 perpendicular to angled reflective surface 130 that intersects the region between light source 100 and light detector 102 of media sensor 16. Light beam 110 contacts angled reflective surface 130 at an angle of incidence 136 measured from normal line 134, and specular light components, such as for example, a specular light component 138, are reflected at an angle 140 measured from normal line 134 and directed away from light detector 102. Angle 140 is substantially equal to angle 136.

From FIG. 4, it can be seen that the direction of light beam 110 is at an angle 141 with respect to plane 86 of media support surface 82. Accordingly, angle 132 of reflective surface 130 can be calculated based on the equation: Angle 132=90−((Σ angles 136, 140, 141)+angle 141)/2. If, for example, the sum of angles 136, 140 and 141 is equal to 90 degrees, and angle 141 is 25 degrees, than angle 132 is 32.5 degrees. Also, in this example, each of angles 136 and 140 is 32.5 degree.

As can be observed from the configuration of FIG. 4, specular light components 138 are directed away from light detector 102 by reflective surface 130, although a small amount of diffuse light, such as diffuse light component 142, may be received by light detector 102.

As shown in the embodiment of FIG. 4, reflector portion 84 includes a plurality of angled surfaces, i.e., a plurality of facets, each extending at an angle in a direction non-parallel to plane 86 of media support 80 at angle 132. The size of the plurality of angled surfaces, such as angled reflective surface 130, is greatly exaggerated in FIG. 4 so that the details of the angular relationship of the various components can be seen more clearly. The plurality of angled surfaces may be populated across reflector portion 84 at, for example, at a rate of about 25 to about 50 angled surfaces per inch (about 10 to about 20 angled surface per centimeter). By providing a plurality of angled surfaces like that of angled reflective surface 130, the exact positioning of media sensor 16 with respect to reflector portion 84 is less critical, since shifting media sensor 16 along plane 86 will simply move the location of impingement of light beam 10 with reflector portion 84 from one angled surface to another without affecting the operation of media sensing apparatus 15. Also, when an angled reflective surface 130 is smaller than the beam width of light beam 110, then the light will be simultaneously reflected from multiple facets, i.e., multiple angled reflective surfaces 130, of reflector portion 84. The actual number of angled surfaces per unit distance can be selected based on machining tolerances to provide as many facets as possible, while preserving a sharp cut off at the distal ends, i.e., the points 144 of the angled surfaces, of reflector portion 84. It is contemplated that alternatively angled reflective surfaces 130 may be located such that the points 144 are positioned at or below media support surface 82.

The embodiment of FIG. 5 differs from that of FIG. 4 in that a gap 146 is formed between media sensor 16 and media support surface 82 so as to space media sensor 16 from media support surface 82, even in the absence of a sheet of print media between media sensor 16 and media support surface 82. In the embodiment of FIG. 5, centerline 104 of media sensor 16 also represents a normal line that is normal to the plane of media support 80, i.e., perpendicular to media support surface 82. The operation of the embodiment of FIG. 5 remains substantially the same as that of the embodiment of FIG. 4, since the geometry of light reflections remain the same.

Figure 6:
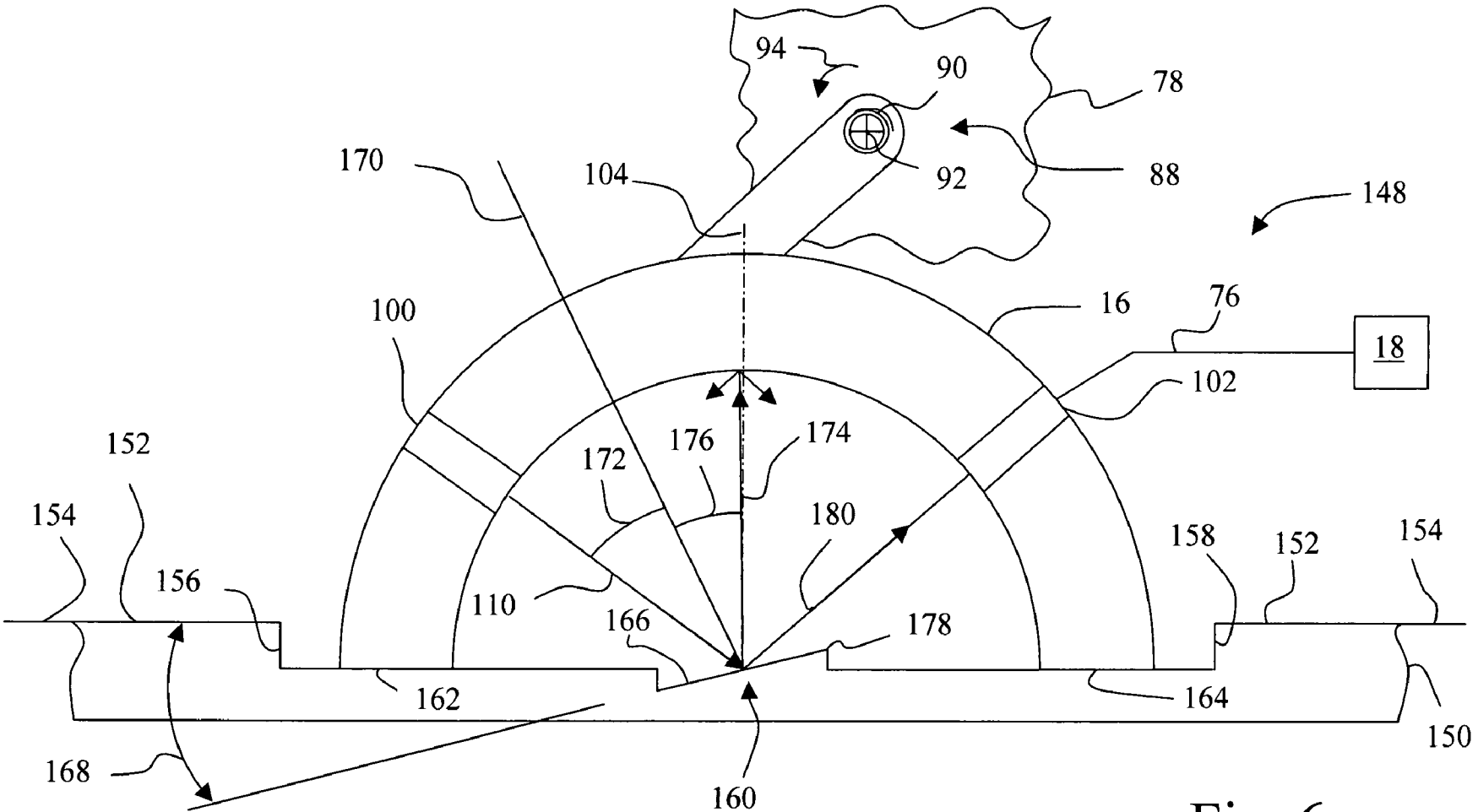
FIG. 6 is another embodiment of a media sensing apparatus embodying the present invention.

FIG. 6 shows another media sensor apparatus 148 embodying the present invention having a media support 150 that can replace the media support 80 of FIGS. 2, 4 and 5. Media support 150 has a media support surface 152 that extends along a plane 154. In the embodiment of FIG. 6, centerline 104 of media sensor 16 also represents a normal line that is normal to the plane 154 of media support 150, i.e., perpendicular to media support surface 152. Media support 150 further includes a first recessed portion 156, a second recessed portion 158 and a reflector portion 160. Reflector portion 160 is positioned between first recessed portion 156 and second recessed portion 158. First recessed portion 156 defines a first recessed surface 162, and second recessed portion 158 defines a second recessed surface 164.

Media sensor 16 is positioned proximate to and facing reflector portion 160 of media support 150, and pivot arm arrangement 88 is biased by spring 90 to pivot about axis 92 in the direction indicated by arrow 94 such that, when no sheet of media is present between reflector portion 160 of media support 150 and media sensor 16, media sensor 16 will contact recessed surfaces 162 and 164 of media support 150. Recessed surfaces 162 and 164 provide support for media sensor 16 below plane 154 of media support 150.

Reflector portion 160 includes an angled reflective surface 166 that extends in a direction non-parallel to plane 154 of media support 150 at an angle 168. As is apparent in FIG. 6, plane 154 extends across reflector portion 160. Angle 168 is selected such that angled reflective surface 166 defines a normal line 170 that intersects the region between light source 100 and light detector 102. Light beam 110 contacts angled reflective surface 130 at an angle of incidence 172 measured from normal line 170, and specular light components 174 are reflected at an angle 176 measured from normal line 170 and directed away from light detector 102. Angle 176 is substantially equal to angle 172. In the reflector portion configuration of FIG. 6, a distal point 178 of angled reflective surface 166 of reflector portion 160 is at, or alternatively below, plane 154 of media support 150. Thus, in this arrangement, the sheet of print media 22 will not be elevated above plane 154 of media support 150 when the sheet of print media 22 is present between media sensor 16 and reflector portion 160 of media support 150.

As can be observed from FIG. 6, in the absence of the sheet of print media 22, specular light components 174 will be directed away from light detector 102, although a small amount of diffuse light components, such as diffuse light component 180, may be received by light detector 102.

Accordingly, with the configurations of the various embodiments of the present invention, the signal strength of the output of light detector 102 when receiving diffuse light components in the absence of print media sheet 22 is significantly less than the output of light detector 102 when receiving the specular light components of the least reflective print media, i.e., the most diffuse media type, such as for example, a sheet of coated paper. Thus, the configurations of the various embodiments of the present invention provide a highly reliable indication of the presence or absence of print media 22. Controller 18 processes the output received from light detector 102, and then determines the presence or absence of print media sheet 22 based on the signal strength of the output received from light detector 102.

While this invention has been described with respect to several embodiments, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An imaging apparatus, comprising:

a media support surface, and a first normal line extending perpendicular to a plane of said media support surface;

a light source positioned at a first angle with respect to said first normal line, said light source producing a light beam;

a light detector positioned at a second angle with respect to said first normal line, said light source and said light detector being positioned on opposite sides of said first normal line, said light detector providing an output;

a reflective surface formed near said media support surface, and a second normal line extending perpendicular to said reflective surface, said first normal line and said second normal line being non-parallel, said reflective surface being formed at a third angle with respect to said plane of said media support surface, said light source and said light detector being positioned in relation to said reflective surface such that when a sheet of print media covers said reflective surface, a reflected specular light component of said light beam is received by said light detector, and when said reflective surface is not covered, said reflective surface directs the reflected specular light component of said light beam away from said light detector, said output of said light detector providing an indication of a presence or an absence of said sheet of print media, wherein a signal strength of said output from said light detector when receiving a diffuse light component reflected from said reflective surface is less than the signal strength of said output from said light detector when receiving the reflected specular light component that is reflected from a low reflectance print media.

2. The apparatus of claim 1, further comprising a controller communicatively coupled to said light detector to receive said output of said light detector.

3. The apparatus of claim 1, said low reflectance print media having a diffuse finish.

4. The apparatus of claim 1, said first angle and said second angle being substantially equal.

5. A method of detecting the presence or absence of a sheet of print media, comprising:

providing a media support surface, and a first normal line extending perpendicular to a plane of said media support surface;

providing a light source positioned at a first angle with respect to said first normal line, said light source producing a light beam;

providing a light detector positioned at a second angle with respect to said first normal line, said light source and said light detector being positioned on opposite sides of said first normal line, said light detector providing an output;

providing a reflective surface formed near said media support surface, and a second normal line extending perpendicular to said reflective surface, said first normal line and said second normal line being non-parallel, said reflective surface being formed at a third angle with respect to said plane of said media support surface;

positioning said light source and said light detector in relation to said reflective surface such that when said sheet of print media covers said reflective surface, a reflected specular light component of said light beam is received by said light detector, and when said reflective surface is not covered, said reflective surface directs the reflected specular light component of said light beam away from said light detector, said output of said light detector providing an indication of a presence or an absence of said sheet of print media; and determining a signal strength of said output from said light detector, wherein the signal strength of said output from said light detector when receiving a diffuse light component reflected from said reflective surface is less than the signal strength of said output from said light detector when receiving the reflected specular light component that is reflected from a low reflectance print media.

6. The method of claim 5, said determining step being performed by a controller communicatively coupled to said light detector.

7. The method of claim 5, said low reflectance print media having a diffuse finish.

8. The method of claim 5, said first angle and said second angle being substantially equal.

9. A media sensing apparatus, comprising:

a media support surface, and a first normal line extending perpendicular to a plane of said media support surface;

a light source positioned at a first angle with respect to said first normal line, said light source producing a light beam;

a light detector positioned at a second angle with respect to said first normal line, said light source and said light detector being positioned on opposite sides of said first normal line, said light detector providing an output;

a reflective surface formed near said media support surface, and a second normal line extending perpendicular to said reflective surface, said first normal line and said second normal line being non-parallel, said reflective surface being formed at a third angle with respect to said plane of said media support surface, said light source and said light detector being positioned in relation to said reflective surface such that when a sheet of print media covers said reflective surface, a reflected specular light component of said light beam is received by said light detector, and when said reflective surface is not covered, said reflective surface directs the reflected specular light component of said light beam away from said light detector, said output of said light detector providing an indication of a presence or an absence of said sheet of print media, wherein a signal strength of said output from said light detector when receiving a diffuse light component reflected from said reflective surface is less than the signal strength of said output from said light detector when receiving the reflected specular light component that is reflected from a low reflectance print media.

10. The apparatus of claim 9, further comprising a controller communicatively coupled to said light detector to receive said output of said light detector.

11. The apparatus of claim 9, said low reflectance print media having a diffuse finish.

12. The apparatus of claim 9, said first angle and said second angle being substantially equal.

13. A media sensing apparatus, comprising:

a reflective surface having a normal line extending perpendicular to said reflective surface; and a media sensor having a centerline, said media sensor including a light source and a light detector, said light source and said light detector being positioned on opposite sides of said centerline, said light source producing a light beam, said light detector providing an output, said light source and said light detector being positioned with respect to said reflective surface; and a controller communicatively coupled to said light detector to receive said output of said light detector, said controller determining a signal strength of said output from said light detector, wherein the signal strength of said output from said light detector when receiving a diffuse light component reflected from said reflective surface is less than the signal strength of said output from said light detector when receiving a reflected specular light component that is reflected from a low reflectance print media, said controller determining a presence or an absence of a sheet of print media based on said signal strength of said output from said light detector.

14. The apparatus of claim 13, said media sensor being positioned with respect to said reflecting surface such that said normal line of said reflecting surface intersects a region between said light source and said light detector.

15. The apparatus of claim 13, further comprising a media support surface, said reflective surface being positioned along said media support surface, said reflective surface being formed at an angle with respect to said media support surface.

16. The apparatus of claim 13, wherein when said sheet of print media covers said reflective surface, said reflected specular light component of said light beam is received by said light detector, and when said reflective surface is not covered, said reflective surface directs said reflected specular light component of said light beam away from said light detector, said output of said light detector providing an indication of said presence or said absence of said sheet of print media.

17. The apparatus of claim 13, said low reflectance print media having a diffuse finish.

18. The apparatus of claim 13, said light detector being the sole light detector in said media sensor.

* * * * *